US010265556B1

(12) United States Patent
Walters

(10) Patent No.: US 10,265,556 B1
(45) Date of Patent: Apr. 23, 2019

(54) ROOFTOP KIT FOR EXTINGUISHING FIRE EMBERS

(71) Applicant: Ian Walters, Elmont, NY (US)

(72) Inventor: Ian Walters, Elmont, NY (US)

( * ) Notice: Subject to any disclaimer, the term of this patent is extended or adjusted under 35 U.S.C. 154(b) by 301 days.

(21) Appl. No.: 15/296,168

(22) Filed: Oct. 18, 2016

(51) Int. Cl.

| | |
|---|---|
| ***A62C 3/02*** | (2006.01) |
| ***A62C 2/10*** | (2006.01) |
| ***E04B 1/94*** | (2006.01) |
| ***E04D 13/00*** | (2006.01) |

(52) U.S. Cl.
CPC ..... *A62C 3/0214* (2013.01); *A62C 2/10* (2013.01); *E04B 1/941* (2013.01); *E04D 13/00* (2013.01)

(58) Field of Classification Search
CPC .... A62C 2/06; A62C 2/10; A62C 3/02; A62C 3/0214; A62C 3/14; E04B 1/941; E04D 13/00
See application file for complete search history.

(56) References Cited

U.S. PATENT DOCUMENTS

| | | | | |
|---|---|---|---|---|
| 1,208,349 | A | 12/1916 | Moody | |
| 3,766,958 | A * | 10/1973 | Mitchell | A62C 2/10 160/1 |
| 4,991,657 | A | 2/1991 | LeLande, Jr. | |
| 5,263,543 | A | 11/1993 | Nigro | |
| 5,732,511 | A | 3/1998 | Scott | |
| 5,829,200 | A * | 11/1998 | Jones | A62C 2/10 52/3 |
| 6,450,264 | B1 | 9/2002 | Christian | |
| 6,929,072 | B2 | 8/2005 | Brown | |
| 6,964,379 | B2 | 11/2005 | Crowley | |
| D542,886 | S | 5/2007 | Crowley | |
| 7,673,696 | B1 | 3/2010 | Gunn | |
| 8,118,109 | B1 | 2/2012 | Hacker | |
| 2004/0035059 | A1 * | 2/2004 | Meyer | A62C 2/10 52/1 |
| 2004/0074152 | A1 * | 4/2004 | Rogers | A62C 3/0214 52/3 |
| 2006/0011356 | A1 * | 1/2006 | Temple | A62C 2/10 169/48 |
| 2009/0260838 | A1 * | 10/2009 | Jungermann | A62C 2/06 169/54 |
| 2010/0058695 | A1 * | 3/2010 | Cropper | A62C 2/10 52/396.01 |

(Continued)

FOREIGN PATENT DOCUMENTS

| | | | | |
|---|---|---|---|---|
| DE | 3922198 | A1 * | 1/1991 | A62C 2/10 |
| WO | 2004062730 | A1 | 7/2004 | |

*Primary Examiner* — Ryan A Reis
(74) *Attorney, Agent, or Firm* — Kyle A. Fletcher, Esq.

(57) ABSTRACT

The roof top kit for extinguishing fire embers is a fire resistant structure that is adapted for use with buildings. The roof top kit for extinguishing fire embers is adapted to mount on the roof of the building. The roof top kit for extinguishing fire embers comprises a passive barrier and an active suppression system. The passive barrier is a fire resistant barrier that is mounted on the building such that there is space between the passive barrier and the structure. The passive barrier provides a physical barrier that prevents embers from wild fires from falling directly upon the roof of the structure. The active suppression system saturates the passive barrier in water. The water extinguishes ignitions that may occur from the embers that have landed on the passive barrier.

18 Claims, 5 Drawing Sheets

(56) References Cited

U.S. PATENT DOCUMENTS

| | | | | |
|---|---|---|---|---|
| 2012/0145418 | A1* | 6/2012 | Su | A62C 3/0214 169/45 |
| 2015/0068776 | A1* | 3/2015 | Douglas | A62C 3/0214 169/48 |
| 2017/0021208 | A1* | 1/2017 | Dor-El | D04B 21/14 |

* cited by examiner

ROOFTOP KIT FOR EXTINGUISHING FIRE EMBERS

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of life saving and firefighting equipment, more specifically, a fire extinguishing system adapted for buildings caught in firestorms.

SUMMARY OF INVENTION

The roof top kit for extinguishing fire embers is a fire resistant structure that is adapted for use with buildings. The roof top kit for extinguishing fire embers is adapted to mount on the roof of the building. The roof top kit for extinguishing fire embers comprises a passive barrier and an active suppression system. The passive barrier is a fire resistant barrier that is mounted on the building such that there is space between the passive barrier and the structure. The passive barrier provides a physical barrier that prevents embers from wild fires from falling directly upon the roof of the structure. The active suppression system saturates the passive barrier in water. The water extinguishes the ignitions that may occur from the embers that have landed on the passive barrier.

These together with additional objects, features and advantages of the roof top kit for extinguishing fire embers will be readily apparent to those of ordinary skill in the art upon reading the following detailed description of the presently preferred, but nonetheless illustrative, embodiments when taken in conjunction with the accompanying drawings.

In this respect, before explaining the current embodiments of the roof top kit for extinguishing fire embers in detail, it is to be understood that the roof top kit for extinguishing fire embers is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the roof top kit for extinguishing fire embers.

It is therefore important that the claims be regarded as including such equivalent construction insofar as they do not depart from the spirit and scope of the roof top kit for extinguishing fire embers. It is also to e understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

Figure 1:
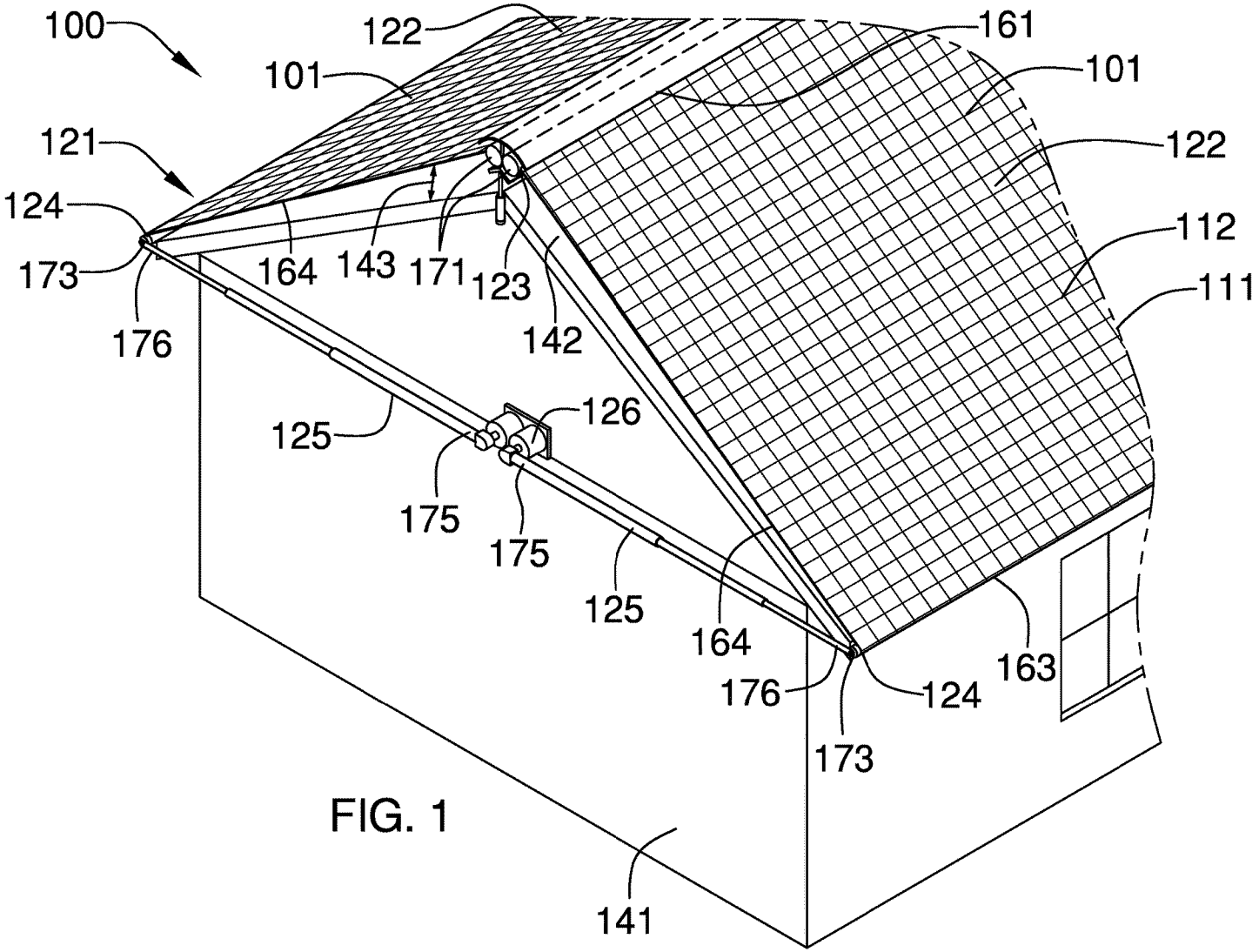
FIG. 1 is a perspective view of an embodiment of the disclosure.

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Detailed reference will now be made to one or more potential embodiments of the disclosure, which are illustrated in FIGS. 1 through 6.

The roof top kit for extinguishing fire embers 100 (hereinafter invention) comprises a passive barrier 101 and an active suppression system 102.

The invention 100 is a fire resistant structure that is adapted for use with a building 141. The invention 100 is adapted for use on the roof 142 of the building 141. The passive barrier 101 is a fire resistant barrier that is mounted on the building 141 such that there is space 143 between the passive barrier 101 and the roof 142 of the building 141. The passive barrier 101 provides a physical barrier that prevents embers from wild fires from falling directly upon the roof 142 of the building 141. The active suppression system 102 saturates the passive barrier 101 in water. The water extinguishes ignitions that may occur from the embers that have landed on the passive barrier 101. The passive barrier 101 is mounted on the roof 142 of the building 141. The active suppression system 102 is mounted on the roof 142 of the building 141 such that the passive barrier 101 can be saturated with water.

The passive barrier 101 comprises a composite textile 111 and supporting structure 121. The composite textile 111 is formed in a rectangular shape. The composite textile 111 is further defined with a first edge 161, a second edge 162, a third edge 163, a fourth edge 164, a first surface 165 and a second surface 166.

The composite textile 111 is a two layer composite material that further comprises a resisting layer 112 and a wicking layer 113. The resisting layer 112 is a first textile that is formed from a fire resistant material that forms a tight structure that physically prevents objects from penetrating the resisting layer 112. The fire resistant material can be formed in a combination of one or more ways. In the first way, the fire resistant material is formed from yarns formed from a fire resistant fiber. Suitable fire resistant fibers include, but are not limited fiberglass or an aromatic polyamide fiber such as a fiber that includes 1,3-benzenediamine in the polymer chain. In the second way, an organo-halogen based fire resistant chemical coating or an organo-phosphorous based fire resistant chemical coating is applied to the resisting layer 112.

In the third way, the fire resistant chemical coating is applied to a fabric formed from the fire resistant fibers. A crosslinked aromatic polyamide copolymer that includes a halogen and that is further coated with one of the fire resistant chemical coatings described above is preferred. The wicking layer 113 is a second textile. The wicking layer 113 is formed with a fiber density such that capillary action within the wicking layer 113 will distribute the water received from the active suppression system 102 across the entire surface of the composite textile 111. While it is preferred that the wicking layer 113 be formed from the same fire resistant fibers as the resisting layer 112 this is not necessary. Methods to join the resisting layer 112 to the wicking layer 113 are well known and documented in the textile arts. The resisting layer 112 and the wicking layer 113 are formed such that the resisting layer 112 forms a first surface 165 of the composite textile 111 and the wicking layer 113 forms the second surface 166 of the composite textile 111. When the composite textile 111 is installed on the roof 142 of a building 141, the second surface 166 is proximal to, but separated in distance from (or not in physical contact with), the roof 142 of a building 141. The first surface 165 is distal from the roof 142 of the building 141.

The supporting structure 121 comprises a frame that that is mounted on the roof 142 of the building 141 such that the composite textile 111 is held in position above the roof 142 of the building 141. The purpose of the supporting structure 121 is to: 1) anchor the composite textile 111 to the roof 142 of the building 141; 2) provide for the space 143 between the roof 142 of the building 141 and the composite textile 111; and, 3) provide mounting locations for the active suppression system 102. Methods, designs, and techniques to make frames that perform the functions of the supporting structure 121 are well known and documented in the mechanical arts. A preferred embodiment of a supporting structure 121 is discussed in more detail elsewhere in this disclosure.

The active suppression system 102 comprises a pump 131, a plurality of nozzles 132, a water manifold 201, and an externally supplied source of water. The pump 131 is a commercially available pump that is used to pump water from the externally supplied source of water to the plurality of nozzles 132. The water manifold 201 is connected to a water pipe 202 that is delivered water via the pump 131.

Each of the plurality of nozzles 132 are mounted on the supporting structure 121 such that the plurality of nozzles 132 will spray water on the wicking layer 113 of the composite textile 111. The wicking layer 113 will distribute water received through the plurality of nozzles 132 across the second surface 166. Any water accumulated by the wicking layer 113 beyond the saturation point of the wicking layer 113 will fall onto the roof 142 of the building 141 thereby further protecting the building 141. Methods to connect pumps to water supplies and nozzles and to control the flow of liquids through nozzles are well known and documented in the plumbing arts. Methods to attach nozzles to frames are well known and documented in the mechanical arts.

It can occur that a plurality of passive barriers 101 and active suppression systems 102 will be required for implementing the invention 100 on the roof 142 of a building 141. In these instances, a single pump 131 can be used in support of multiple instantiations of the invention 100.

In the first potential embodiment of the disclosure, as shown in FIGS. 1 through 6, the supporting structure 121 is an outrigger structure that comprises a plurality of half structures 122 that hold the passive barrier 101 above and beyond the exterior of the building 141. As shown in FIG. 1, the supporting structure 121 comprises a plurality of half structures 122 wherein each half structure selected from the plurality of half structures 122 is an instantiation of the invention 100. Each half structure selected from the plurality of half structures 122 is identical to the remaining half structures remaining in the plurality of half structures 122.

Each of the plurality of half structures 122 comprises a take up roller 123, a draw boom 124, a first boom 125, a first boom motor 126, a second boom 127, a second boom motor 128, and one or more take up motors 129. The take up roller 123 is a cylindrical structure upon which the passive barrier 101 is rolled for storage and unrolled for use. As shown in FIG. 1, the first edge 161 of the passive barrier 101 is attached to the take up roller 123. The take up roller 123 is further defined with a first end 171 and a second end 172.

The draw boom 124 is a cylindrical shaft that is attached to the third edge 163 of the passive barrier 101. The draw boom 124 is further defined with a third end 173 and a fourth end 174. The draw boom 124 is used to: 1) draw the passive barrier 101 off the take up roller 123 during the deployment of the invention 100; and, 2) maintain tension during deployment of the passive barrier 101 such that there is a space 143 between the passive barrier 101 and the roof 142 of the building 141.

The first boom 125 is a telescopic shaft structure that is used as a spreader, also referred to as an aku, which is used to deploy the passive barrier 101. The first boom 125 is further defined with a fifth end 175 and a sixth end 176. The sixth end 176 of the first boom 125 is attached to the third end 173 of the draw boom 124. The fifth end 175 of the first boom 125 is attached to a first boom motor 126. As shown most clearly in FIGS. 2 and 4, the first boom motor 126 is an electric motor that is used to draw the passive barrier 101 off the take up roller 123 by rotating the first boom 125 over a 90 degree arc. As the first boom motor 126 rotates the first boom 125, the sixth end 176 of the first boom 125 moves away from the take up roller 123 thereby drawing the passive barrier 101 off the take up roller 123. The purpose of the telescopic shaft structure is to allow the length of the first boom 125 to accommodate the non-spherical nature of traditional structures.

The second boom 127 is a telescopic shaft structure that is used as a spreader, also referred to as an aku, which is used to deploy the passive barrier 101. The second boom 127 is further defined with a seventh end 177 and an eighth end 178. The eighth end 178 of the second boom 127 is attached to the fourth end 174 of the draw boom 124. The seventh end 177 of the second boom 127 is attached to a second boom motor 128. As shown most clearly in FIGS. 2 and 4, the second boom motor 128 is an electric motor that is used to draw the passive barrier 101 off the take up roller 123 by rotating the second boom 127 over a 90 degree arc. As the second boom motor 128 rotates the second boom 127, the eighth end 178 of the second boom 127 moves away from the take up roller 123 thereby drawing the passive barrier 101 off the take up roller 123. The purpose of the telescopic shaft structure is to allow the length of the second boom 126 to accommodate the non-spherical nature of traditional structures.

Figure 2:
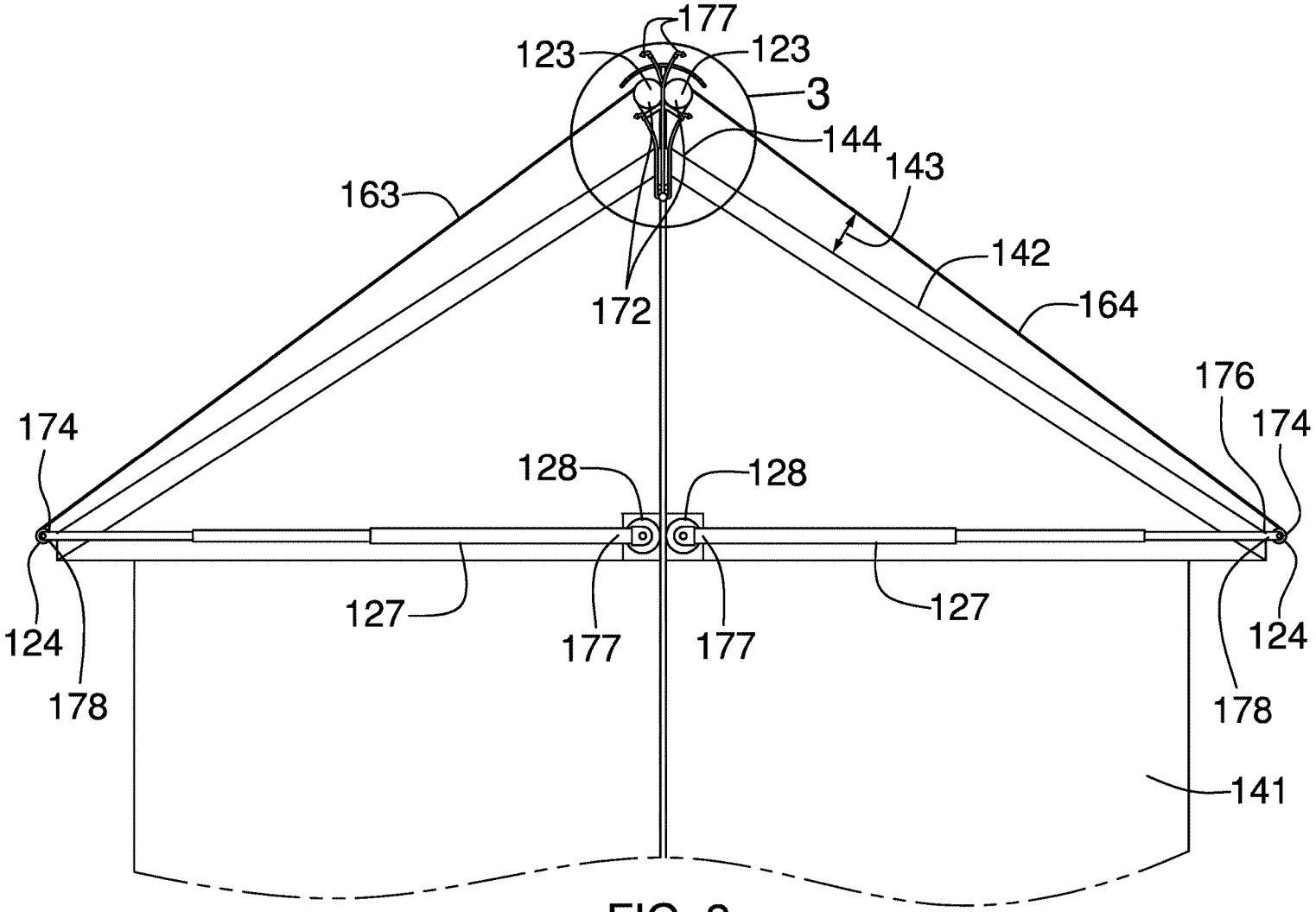
FIG. 2 is a front view of an embodiment of the disclosure.
Figure 4:
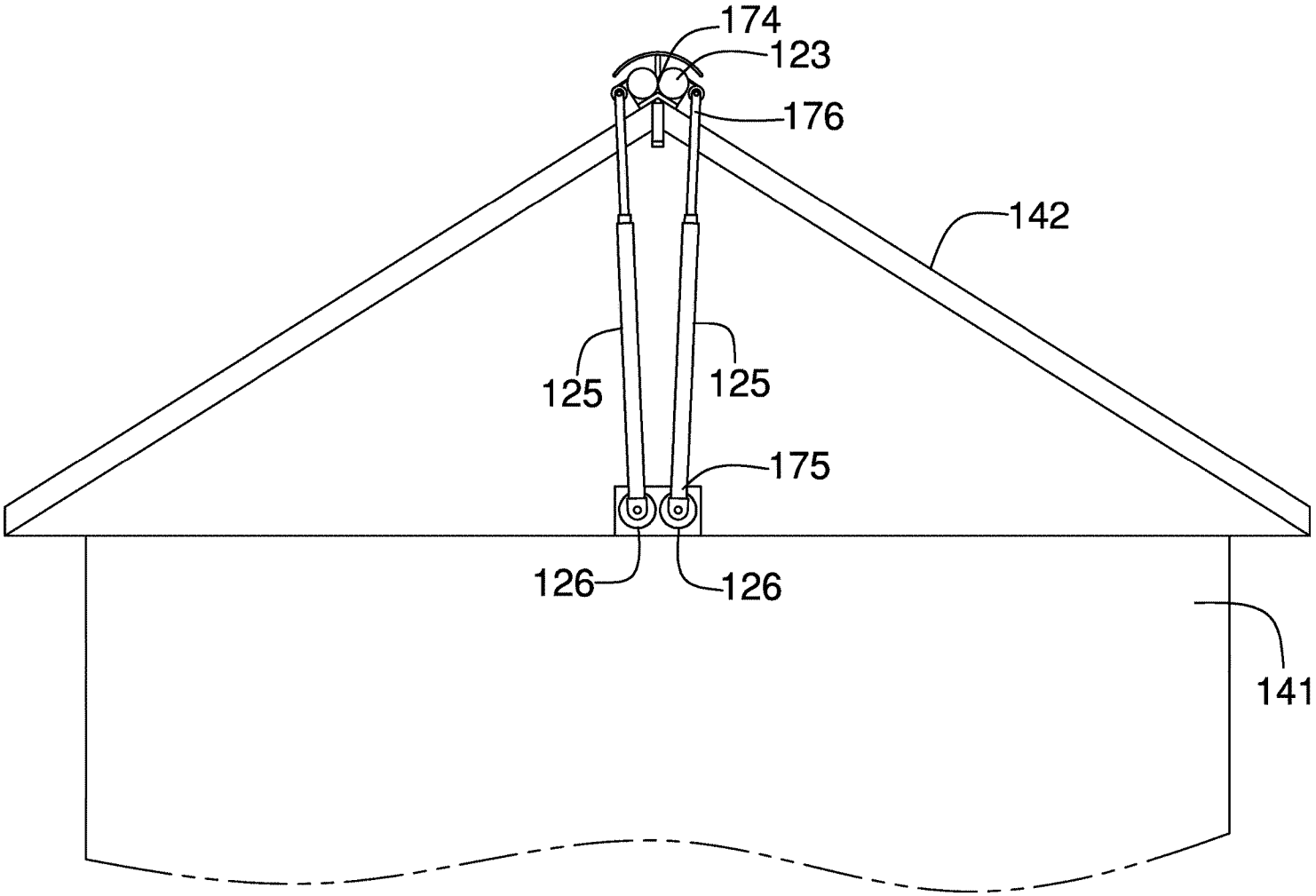
FIG. 4 is a rear view of an embodiment of the disclosure.
Figure 5:
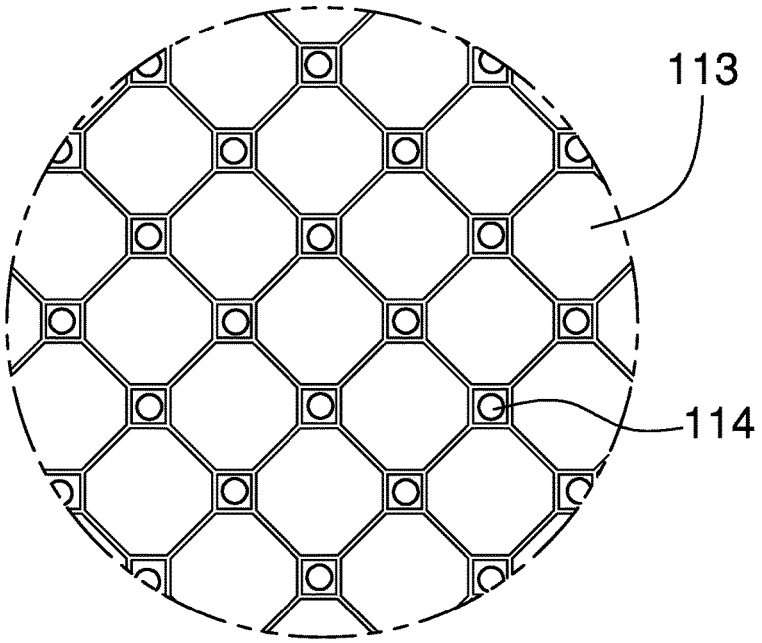
FIG. 5 is a cross-sectional view of an embodiment of the disclosure across 5-5 as shown in FIG. 3.

As shown most clearly in FIGS. 2 and 4, the first boom motor 126 and the second boom motor 128 are mounted on opposite sides of the building 141.

As shown in FIGS. 1, 2, 3, and 4, to install the first potential embodiment of the disclosure, the draw boom 124 is mounted above the roof 142 of the building 141 such that the take up roller 123 is above the roof 142 ridge 144. The take up roller 123 is mounted to the building 141 using a plurality of support struts 181. Methods to mount rotating objects on a structure are well known and documented in the mechanical arts. As shown most clearly in FIG. 3, the plurality of nozzles 132 of the active suppression system 102 are mounted on the structure supporting the take up roller 123.

In order to retract the passive barrier 101 back onto the take up roller 123, one or more take up motors 129 are attached to the take up roller 123 such that the take up roller 123 can be rotated in a direction that retracts the passive barrier 101. Methods to install motors for this purpose are well known and documented in the mechanical arts.

Figure 6:
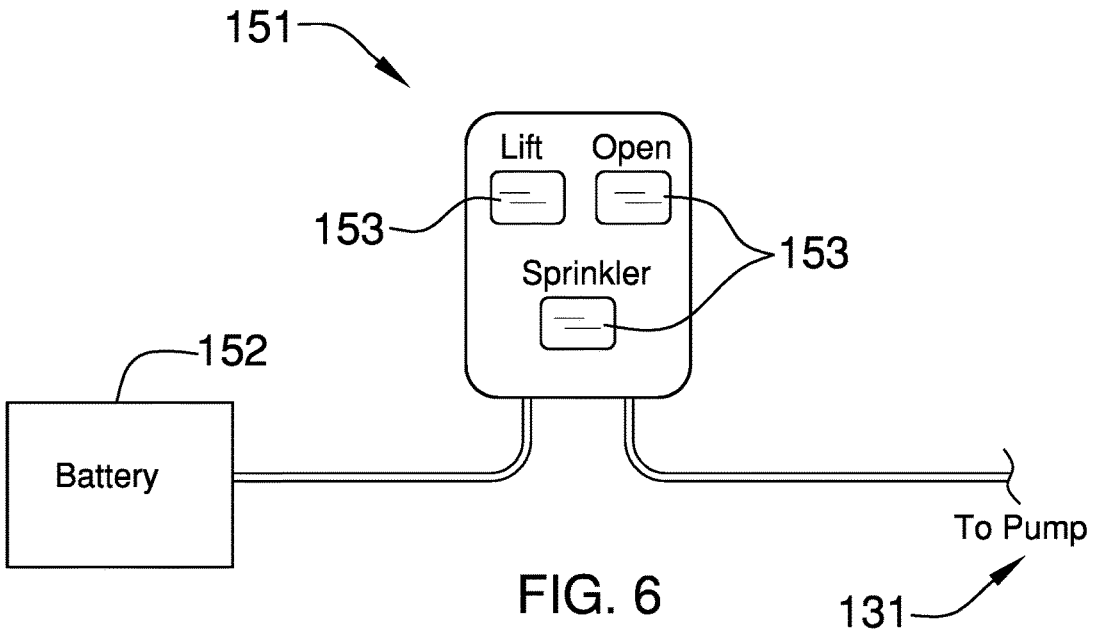
FIG. 6 is a detail view of an embodiment of the disclosure.

As shown most clearly in FIG. 6, the invention 100 is operated through the use of a control system 151. The control system 151 is used to operate the motors that deploy and retract the passive barrier 101 and that begin operation of the active suppression system 102 using a plurality of switches 153. The control system 151 further comprises a battery 152 back up to allow for the continued operation of the invention 100 in the event of electrical power loss.

Figure 3:
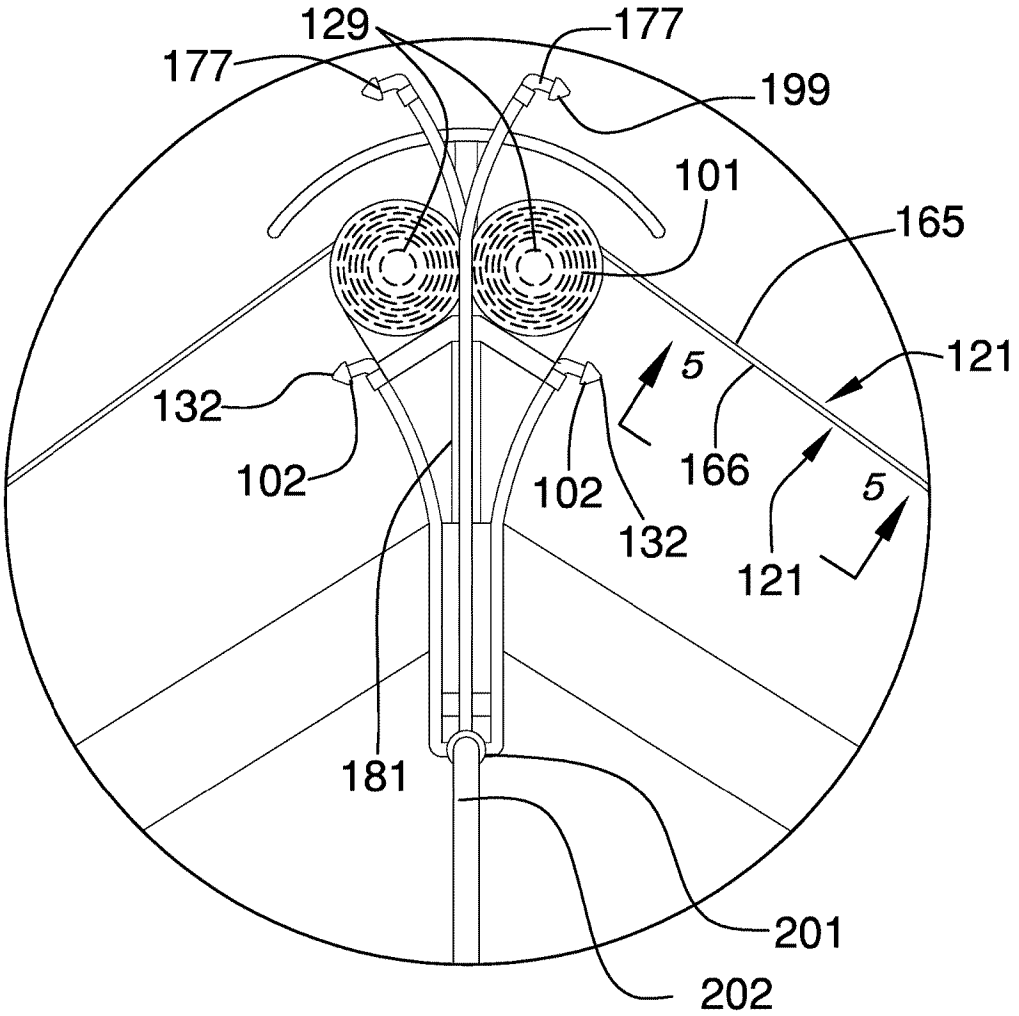
FIG. 3 is a detail view of an embodiment of the disclosure.

Referring to FIGS. 2-3, an alternative embodiment of the disclosure may include a plurality of outer spray nozzles 199. The plurality of outer spray nozzles 199 extend above a ridge member 200. The ridge member 200 is a curved object that is configured to be positioned above the ridge 144 of the roof 142. The plurality of outer spray nozzles 199 dispense water onto and above the composite textile 111. Alternatively, the plurality of outer spray nozzles 199 may be used to spray water directly onto the roof 142. The plurality of outer spray nozzles 199 are connected to the water manifold 201 as well as the plurality of nozzles 132.

The following definitions were used in this disclosure:

Battery: As used in this disclosure, a battery is a container consisting of one or more cell in which chemical energy converted into electricity and used as a source of power.

Composite Textile: As used in this disclosure, a composite textile is a multilayer fabric made of two or more joined layers of textile or sheeting materials.

Outrigger: As used in this disclosure, an outrigger is a beam, frame or other first structure that is attached to, but extends beyond the defined boundaries of a second structure.

Pump: As used in this disclosure, a pump is a mechanical device that uses suction or pressure to raise or move liquids, compress gasses, or force a gas into an inflatable object.

Sheeting: As used in this disclosure, sheeting is a material, such as cloth or plastic, in the form of a thin flexible layer or layers.

Textile: As used in this disclosure, a textile is a material that is woven, knitted, braided or felted. Synonyms in common usage for this definition include fabric and cloth.

With respect to the above description, it is to be realized that the optimum dimensional relationship for the various components of the invention described above and in FIGS. 1 through 6, include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The inventor claims:

1. A fire retarding system comprising:

a passive barrier and an active suppression system;

wherein the fire retarding system is a fire resistant structure that is adapted for use with a building;

wherein the fire retarding system is adapted for use on a roof of the building;

wherein the passive barrier is a fire resistant barrier that is adapted to be mounted on the building such that there is space between the passive barrier and the roof of the building;

wherein the passive barrier provides a physical barrier that prevents embers from wild fires from falling directly upon the roof of the building;

wherein the active suppression system saturates the passive barrier in water;

wherein the water extinguishes ignitions that may occur from the embers that have landed on the passive barrier;

wherein the passive barrier is adapted to be mounted on the roof of the building;

wherein the active suppression system is mounted on the roof of the building such that the passive barrier can be saturated with water;

wherein the passive barrier comprises a composite textile and supporting structure;

wherein the passive barrier is mounted on the supporting structure;

wherein the composite textile is formed in a rectangular shape;

wherein the composite textile is further defined with a first edge, a second edge, a third edge, a fourth edge, a first surface and a second surface;

wherein the supporting structure comprises a take up roller, a draw boom, a first boom, a first boom motor, a second boom, a second boom motor, and one or more take up motors;

wherein the take up roller is a cylindrical structure upon which the passive barrier is rolled for storage and unrolled for use;

wherein the first edge of the passive barrier is attached to the take up roller;

wherein the take up roller is further defined with a first end and a second end;

wherein the draw boom is a cylindrical shaft that is attached to the third edge of the passive barrier;

wherein the draw boom is further defined with a third end and a fourth end;

wherein the draw boom maintains tension during deployment of the passive barrier such that there is a space between the passive barrier and the roof of the building;

wherein the first boom is a telescopic shaft structure;

wherein the first boom is further defined with a fifth end and a sixth end;

wherein the sixth end of the first boom is attached to the third end of the draw boom;

wherein the fifth end of the first boom is attached to a first boom motor;

wherein as first boom motor rotates the first boom, the sixth end of the first boom moves away from the take up roller;

wherein the second boom is a telescopic shaft structure;

wherein the second boom is further defined with a seventh end and an eighth end;

wherein the eighth end of the second boom is attached to the fourth end of the draw boom;

wherein the seventh end of the second boom is attached to a second boom motor;

wherein as the second boom motor rotates the second boom, the eighth end of the second boom moves away from the take up roller.

2. The fire retarding system according to claim 1 wherein the composite textile comprises a plurality of layers;

wherein the plurality of layers further comprises a resisting layer and a wicking layer;

wherein the resisting layer attaches to the wicking layers.

3. The fire retarding system according to claim 2 wherein the resisting layer is a first textile that is formed from a fire resistant material;

wherein the fire resistant material physically prevents objects from penetrating the resisting layer.

4. The fire retarding system according to claim 3 wherein the resisting layer is formed from a plurality of fire resistant fibers;

wherein the plurality of fire resistant fibers further comprises fiberglass fibers.

5. The fire retarding system according to claim 3 wherein the resisting layer is formed from a plurality of fire resistant fibers;

wherein the plurality of fire resistant fibers further comprises a polymer chain that includes 1,3-benzenediamine.

6. The fire retarding system according to claim 3 wherein the first textile is coated in chemical selected from the group consisting of a chemical comprising an organo-halogen based fire resistant chemical coating or an organo-phosphorous based fire resistant chemical coating.

7. The fire retarding system according to claim 6 wherein the wicking layer is formed from the same fire resistant fibers as the resisting layer.

8. The fire retarding system according to claim 7 wherein the first textile further comprises a plurality of fire resistant fibers;

wherein the plurality of fire resistant fibers comprises fibers selected from the group consisting of fiberglass fibers or a polymer chain containing an aromatic polyamide fiber.

9. The fire retarding system according to claim 8 wherein the wicking layer is formed from the same fire resistant fibers as the resisting layer.

10. The fire retarding system according to claim 6 wherein the first textile further comprises a plurality of fire resistant fibers;

wherein the plurality of fire resistant fibers further comprises a polymer chain that includes 1,3-benzenediamine.

11. The fire retarding system according to claim 6 wherein the plurality of fire resistant fibers comprises fibers comprising a crosslinked aromatic polyamide copolymer that includes a halogen.

12. The fire retarding system according to claim 11 wherein the crosslinked aromatic polyamide copolymer that includes a halogen further comprises 1,3-benzenediamine in the polymer chain.

13. The fire retarding system according to claim 12 wherein the wicking layer is formed from the same fire resistant fibers as the resisting layer.

14. The fire retarding system according to claim 9 wherein the supporting structure comprises a frame that that is mounted on the roof of the building such that the composite textile is held in position above the roof of the building.

15. The fire retarding system according to claim 14 wherein the active suppression system comprises a pump, a plurality of nozzles, a water manifold, and an externally supplied source of water;

wherein each of the plurality of nozzles are mounted on the supporting structure such that the plurality of nozzles will spray water on the wicking layer of the composite textile;

wherein the pump is used to pump water from the externally supplied source of water to the plurality of nozzles;

wherein the water manifold is connected to a water pipe that is delivered water via the pump.

16. The fire retarding system according to claim 15 wherein a plurality of outer spray nozzles is included with the active suppression system; wherein the plurality of outer spray nozzles extend above a ridge member.

17. The fire retarding system according to claim 16 wherein the ridge member is a curved object that is configured to be positioned above the ridge of the roof.

18. The fire retarding system according to claim 17 wherein the plurality of outer spray nozzles dispense water onto and above the composite textile; wherein the plurality of outer spray nozzles are connected to the water manifold as well as the plurality of nozzles.

* * * * *